United States Patent [19]

Hecht et al.

[11] Patent Number: 4,814,235

[45] Date of Patent: Mar. 21, 1989

[54] USE OF OXYGEN-FREE COPPER DEOXIDIZED BY BORON OR LITHIUM AS MATERIAL FOR HOLLOW SECTIONS

[75] Inventors: Meinhard Hecht, Hasbergen; Werner Rethmann, Georgsmarienhütte, both of Fed. Rep. of Germany

[73] Assignee: Kabel- und Metallwerke Gutehoffnungshütte AG, Osnabrück, Fed. Rep. of Germany

[21] Appl. No.: 99,682

[22] Filed: Sep. 17, 1987

Related U.S. Application Data

[63] Continuation of Ser. No. 757,548, Jul. 19, 1985, abandoned.

[30] Foreign Application Priority Data

Jul. 21, 1984 [DE] Fed. Rep. of Germany ..... 3427034

[51] Int. Cl.[4] ..... C22F 1/08

[52] U.S. Cl. ..... 428/586; 148/3; 148/13.2; 148/432

[58] Field of Search ..... 428/586; 148/3, 13.2, 148/432; 164/113, 76.1, 120, 477

[56] References Cited

U.S. PATENT DOCUMENTS

| | | | |
|---|---|---|---|
| 1,023,604 | 4/1912 | Weintraub | 420/469 |
| 2,003,889 | 6/1933 | Jennison | 420/469 |
| 2,183,592 | 12/1939 | Silliman | 420/469 |
| 2,479,311 | 8/1949 | Christensen et al. | 420/469 |
| 2,964,397 | 12/1960 | Cooper | 420/469 |
| 3,352,667 | 11/1967 | Das | 420/469 |
| 3,836,360 | 9/1974 | Bray | 420/469 |
| 4,118,256 | 10/1978 | Schmitt-Thomas et al. | 420/469 |

OTHER PUBLICATIONS

Metals Handbook, 8th Ed., Vol. 1, Properties and Selection of Metals, 1961, pp. 1010–1011.

Chemical Abstracts, 92:80806e, Masumoto et al., "Cooper Base Alloy", Sep. 1979.

Chemical Abstracts, 98:202669j, Pimenov et al., "Peoxidation of Copper During Production of Shaped Castings", 1983.

Anaconda—Cooper and Copper Alloys, The American Brass Co., Publication B-32, Jun. 1958, pp. 2–3.

Prometall, Beissner et al., "Profilés Creux en Cuivre pour Emplois Spéciaux", pp. 678–683, 1962.

*Primary Examiner*—John J. Zimmerman

*Attorney, Agent, or Firm*—Martin A. Farber

[57] ABSTRACT

In a hollow section of oxygen-free copper deoxidized with boron or lithium, which is to be pressed over a bridge tool, the percentage of the deoxidizing agent, boron or lithium, in the finished product is 0.01% to 0.05%. The electrical conductivity of the finished section is at least 95% IACS.

11 Claims, 1 Drawing Sheet

USE OF OXYGEN-FREE COPPER DEOXIDIZED BY BORON OR LITHIUM AS MATERIAL FOR HOLLOW SECTIONS

RELATED APPLICATION

This application is a continuation of our co-pending application Ser. No. 757,548 filed July 19, 1985 now abandoned.

FIELD AND BACKGROUND OF THE INVENTION

The invention relates to hollow sections which are produced by pressing on a bridging tool and which have an electric conductivity of at least 95% IACS (International Annealed Copper Standard).

The demand for constantly higher power per unit of volume on the part of electric machines, induction furnaces, magnetic coils and similar units requires the use of special material and constructions for practically all construction parts, particularly current-carrying conductor elements. Due to the high current load on the conductors, heating takes place to such an extent as to make increased cooling necessary in order to reduce the losses, keep the thermal imbalances small and bring the changes in length, which frequently have a very disagreeable effect, within controllable limits. Indirect cooling of such conductor elements is no longer sufficient for such high power density. For these reasons a shift has taken place towards direct cooling of copper conductors, for instance internal conductor cooling. For this purpose, specially developed hollow sections have been designed. A number of requirements must be satisfied by these hollow sections. First of all, the hollow sections must be absolutely sealed, since they are generally cooled with hydrogen gas or a liquid, for instance water. Furthermore, high mechanical strength is required in order to prevent the hollow section from being deformed under the action of high centrifugal forces. High electrical condutivity is desired to prevent excessive heating of the conductor sections.

Such hollow sections are described in "Prometall," 1962, pages 678 to 683. Continuous casting over a bridging tool is desired as being the most advantageous manner of manufacturing such hollow sections. The heated copper is pressed around the bridge, which has one or more mandrels or mandrel extensions which form the hollow duct or ducts. The two streams of metal are combined in the region of the die and welded together there uner strong pressure. After the pressing, the hollow sections are brought, in one or more steps into the desired final shape, bright annealing being possibly effected between the individual steps.

The said article requires electrolytic copper, oxygen-free copper or else a copper-silver alloy as material for such hollow conductors. The copper of most favorable price and which at the same time also has the highest condutivity is commercial electrolytic copper. Its oxygen content is about 0.02 to 0.04%. This high oxygen content can lead to the dreaded hydrogen disease which is of importance, in particular, for welding and soldering work. Oxygen-free copper, i.e. copper having no oxygen bound to copper, has an oxygen content which is about 10 times less, is insensitive to hydrogen embrittlement and has a somewhat higher softening point but, in general, a conductivity which is about 1% less.

Oxygen-free deoxidized grades of copper of high electrical conductivity are standardized by DIN 1708.

The copper content is at least 99.90%; the deoxidizing agent, which is ordinarily phosphorus, is present in an amount of about 0.003%. Upon fabricating these types of copper by means of bridge tools, defects can occur in the region of the streams of material which are to be welded together. As cause of these defects there enter into consideration primarily enrichments of hydrogen in the region of the weld seam, where a hydrogen-disease structure is formed upon intermediate and/or final annealings in a hydrogen-containing atmosphere, and this may lead to the formation of cracks. The oxygen passes into the weld seam, for instance, via the oxides adhering to the surface of the block, which have oxides are upon the heating or the bringing of the block to the press, particularly on its end surface.

SUMMARY OF THE INVENTION

The object of the present invention is to provide a material which can be pressed over a bridge tool into a hollow section without the occurrence of defects in the press-weld seam caused by the bridge web. The material furthermore is to have an electrical conductivity of at least 95% IACS and be immune to hydrogen.

This object is achieved by the use of an oxygen-free copper which has been deoxidized by boron or lithium. It is essential for the invention that the deoxidizing agent, boron or lithium, be present in the final product in an amount of 0.01 to 0.05%.

In addition to the advantages which are directly evident from the object in view, it has been observed that there is substantially less scale on the surface of the pressed section. Furthermore, there is substantially less accumulation of oxide on the bridge tool. This accumulation of oxide is considered one of the causes of defective weld seams when these oxides, for instance, flow from the bridge tool into the weld zone. In order to avoid this, the bridge tool had to be frequently replaced or cleaned, which can be dispensed with by the use of the new material. Furthermore, the extruded profile is characterized by a substantially smoother surfaces. It has also been found that the structure in the region of the weld seam is more finely granular than in the case of the materials previously used.

It is particularly advantageous if the boron is present in the final product in an amount of 0.015 to 0.25%. The invention can be used to advantage in the case of internally cooled conductors under high electrical load.

The invention furthermore concerns a method of manufacturing an alloy in accordance with the teaching of the invention, characterized by the fact that the deoxidizing agent is added to the molten copper, directly before the casting, in the form of a pre-alloy containing the deoxidizing agent, preferably in the casting through. Since the said deoxidizing agents, boron or lithium, have a very great affinity for oxygen, they are able, for instance, to reduce other metal oxides, i.e. metal oxides contained in the refractory lining, which metals can then pass into the melt and thereby reduce the conductivity in undesired manner. Thus it is possible, for instance, for the boron or lithium to reduce silicon or even iron from the lining of the crucible. For this reason, the time of contact of the melt or deoxidizing agent with such crucible linings should be kept as short as possible. It is therefore particularly advantageous for the pre-alloy to be added directly into the casting stream. As deoxidizing agent there is advisedly used a copper-boron alloy in which the percentage of boron is between 1.5% and 5%. The percentage of boron is established in such a manner that, on the one hand, no large amounts of cold pre-alloy need be added to the melt while, on the other hand, the pre-alloy is not substantially lighter in its density than the copper melt, so that intimate mixing of the two components is obtained.

With the above and other objects and advantages in view, the present invention will become more clearly understood in connection with the detailed description of a preferred embodiment, when considered with the accompanying drawing, of which:

DETAILED DESCRIPTION OF THE PREFERRED EMBODIMENT

Figure 1:
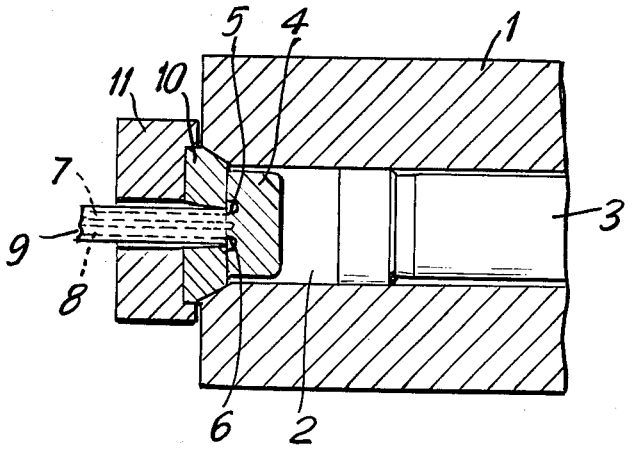
FIG. 1 shows a sectional view of extrusion device.

FIG. 1 shows a pressing apparatus which consists of a block receiver or receptacle 1 into which the block 2 of oxygen-free copper is introduced. By means of a ram 3 the block 2 is pressed against a bridge web 4 and divided into two individual streams. The bridge web has, for instance, two mandrel extensions 5 and 6 which produce two channels 7 and 8 in the final pressed section 9. The channels 7 and 8 are shown in dashed line in FIG. 1. The outside dimensions of the final section 9 are determined by the die 10. Bridge web 4 and die 10 are supported in the tool holder by a pressure plate 11. Since high pressures are necessary for the welding together of the two individual streams—these pressures are produced by suitable shaping of the bridge—web and the block 2 is heated to approximately 900° C., both the bridge web 4 and the die 10 must be made of a high temperature material.

Figure 2:
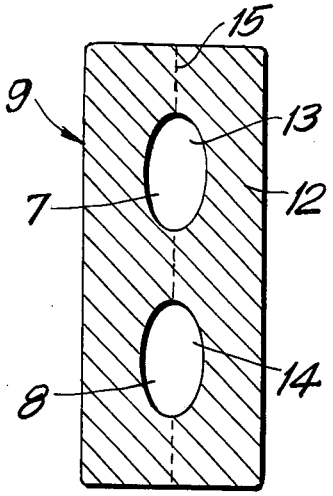
FIG. 2 is a cross-section of the extruded product.

FIG. 2 is a cross section through a completed section 9 (12) in which there are two elliptical channels 13 and 14. The press weld seam 15 is shown in dashed line.

In an experiment, several test blocks were cast in a continuous-casting installation. As starting material copper cathodes were used and deoxidation was effected with a copper-boron alloy containing 2% boron. The blocks had a diameter of 180 mm and a length of 300 to 400 mm. These blocks were heated to 900° C. and pressed in an apparatus according to FIG. 1 so as to form a hollow section. Conductivity tests on the pressed hollow section showed an electrical conductivity of more than 58 m/Ω mm$^2$. The residual boron content was 0.02%. The pressed section produced in this way was drawn down in several steps to the desired final dimension, the sections being soft-annealed at about 500° C. in a slightly reduced atmosphere between the individual drawings.

The following tests were carried out on the completely drawn sections:

1. macroetching

2. bending test in received condition

3. bending test after hydrogen annealing (850° C./¼ hour)

Upon the macroetching, the position of the weld seam could not be noted in any case. Neither the bending test in received condition nor the bending test after hydrogen annealing led to a failure of the sections.

The invention can be employed to the same advantage for sections which, in general, because of their cross-sectional shape, can be pressed only over bridge tools, e.g. sections with 3 or 4 boreholes or sections having an unequal weight distribution.

We claim:

1. A hollow substantially oxygen-free copper extrusion having good electric conductivity, suitable for use as an internally cooled electrical conductor in the formation of coils in electric power equipment formed by the process of:

deoxidizing a block of copper so as to be substantially oxygen-free with a deoxidizing agent, said agent being an alloy of copper with a deoxidant selected from at least one of the class of metallic deoxidants consisting of lithium and boron;

heating said block of copper to a temperature of approximately 900° C. to provide sufficient fluidity to the copper to permit extrusion thereof, said metallic deoxidant being present in said copper with a weight percent of 0.01–0.05;

pressing said copper past a bridge in an extrusion machine to form an extrusion of the copper, said bridge having a mandrel for forming a hollow region within the extrusion, said bridge enveloping a weld seam in said extrusion; and annealing the copper extrusion at a temperature of approximately 500° C., said deoxidizing agent inhibiting the formation of material defects along said seam.

2. The extrusion according to claim 1, wherein said deoxidizing is accomplished with an alloy of copper and boron having 2% boron, and wherein the electrical conductivity of the opper in said extrusion is at least 95% IACS.

3. The extrusion according to claim 1, wherein said deoxidizing is accomplished with an alloy of copper and boron having 2% boron, and wherein the electrical conductivity of the copper in said extrusion is more than 100% IACS.

4. The extrusion according to claim 1, wherein said boron is present in said extrusion with a weight percentage of 0.015 to 0.025.

5. A finished product comprising a hollow section of substantially oxygen-free opper deoxidized by a deoxidant selected from at least one of the metal deoxidants consisting of boron and lithium, said deoxidant being present in the finished product with a weight percentage of 0.015 to 0.025, and wherein the electrical condutivity of the copper in said finished product is at least 95% IACS.

6. A method of manufacturing a hollow extrusion of substantially oxygen-free copper having good electric conductivity, comprising the steps of:

preparing a melt of copper;

deoxidizing said copper so as to be substantially oxygen-free with a deoxidizing agent in said melt, said agent being an alloy of copper with a deoxidant selected from at least one of the class of metal deoxidants consisting of boron and lithium;

heating said copper to a temperature of approximately 900° C. to provide sufficient fluidity to the copper to permit extrusion thereof, said metallic deoxidant being present in said copper with a weight percentage of 0.01–0.05;

pressing said copper past a bridge in an extrusion machine to form an extrusion of the copper, said bridge having a mandrel for forming a hollow region within the extrusion, said bridge enveloping a weld seam in said extrusion; and annealing the copper extrusion at a temperature of approximately 500° C., said deoxidizing agent inhibiting the formation of material defects along said seam.

7. The method according to claim 6, wherein said deoxidizing is accomplished with an alloy of copper and boron having 2% boron, and wherein the electrical conductivity of the copper in said extrusion is at least 95% IACS.

8. The method according to claim 6, wherein said boron is present in said extrusion with a weight percentage of 0.015 to 0.025.

9. The method according to claim 8, wherein the deoxidizing agent is added to the melt of said copper in the form of a pre-alloy containing the deoxidizing agent prior to said pressing.

10. The method according to claim 9, wherein the copper melt is deoxidized with a copper-boron alloy with 1.5% to 5% by weight.

11. The method according to claim 10, wherein the pre-alloy is added into the casting stream.

* * * * *